US011096431B1

(12) United States Patent
Klein

(10) Patent No.: US 11,096,431 B1
(45) Date of Patent: Aug. 24, 2021

(54) NURSING GARMENT WITH INTEGRAL PRIVACY FLAP FOR USE WHILE BREASTFEEDING IN PUBLIC

(71) Applicant: Camy Eve Klein, Boynton Beach, FL (US)

(72) Inventor: Camy Eve Klein, Boynton Beach, FL (US)

( * ) Notice: Subject to any disclaimer, the term of this patent is extended or adjusted under 35 U.S.C. 154(b) by 34 days.

(21) Appl. No.: 16/653,249

(22) Filed: Oct. 15, 2019

Related U.S. Application Data

(60) Provisional application No. 62/791,774, filed on Jan. 12, 2019.

(51) Int. Cl.
*A41D 1/215* (2018.01)
*A41D 15/00* (2006.01)

(52) U.S. Cl.
CPC ..... *A41D 1/215* (2018.01); *A41D 15/00* (2013.01)

(58) Field of Classification Search
CPC ..... A41D 1/215; A41D 2/21; A41D 15/00; A41D 16/1236; A41D 13/1245; A41D 13/1281; A41D 1/21; A41C 3/04; A41C 3/08; A41B 9/06
USPC ..... 2/114, 104; 450/36, 28, 30, 31, 32, 33
See application file for complete search history.

(56) References Cited

U.S. PATENT DOCUMENTS 1,290,142 A 8/1918 Elowsky
4,004,294 A 1/1977 Pinch
4,144,493 A 3/1979 Lee et al.
4,144,593 A * 3/1979 Timmons ..... A41D 1/215 2/104
4,173,842 A 11/1979 Bahner
4,528,699 A * 7/1985 Hughes ..... A41D 1/215 2/104
4,566,136 A 1/1986 Echols
4,601,068 A 7/1986 Frechette
4,660,227 A 4/1987 Abramson
5,611,086 A 3/1997 Eggen
6,282,720 B1 * 9/2001 Mayer ..... A41B 9/06 2/113
6,839,908 B2 1/2005 Schneider
8,906,140 B2 12/2014 Stark et al.
2005/0028243 A1 * 2/2005 Polzin ..... A41D 1/215 2/104
2007/0074330 A1 4/2007 Azaronak
(Continued)

FOREIGN PATENT DOCUMENTS

EP 1362520 5/2003

*Primary Examiner* — Katherine M Moran
*Assistant Examiner* — Haley A Smith
(74) *Attorney, Agent, or Firm* — Mark D. Bowen, Esq.; Malin Haley DiMaggio & Bowen, P.A.

(57) ABSTRACT

A nursing garment has the outward appearance of a conventional women's top while including an integral privacy flap which allows for discrete and concealed breastfeeding even in public spaces. The nursing garment functions to provide a privacy flap that is integrally formed with the front of the garment and configurable between a normally worn configuration wherein the privacy flap forms the front outer layer of the garment and is affixed to the garment by invisible fasteners running along the side seams and nursing configuration wherein the front layer is deployed to form a privacy flap capable of concealing the breast and infant while breast feeding or utilizing a breast pump in pubic.

2 Claims, 7 Drawing Sheets

(56) References Cited

U.S. PATENT DOCUMENTS

| | | | | |
|---|---|---|---|---|
| 2009/0000008 | A1* | 1/2009 | Moore | A41D 1/215 2/104 |
| 2009/0265830 | A1 | 10/2009 | Hendrickson | |
| 2009/0265831 | A1 | 10/2009 | Hendrickson | |
| 2009/0282603 | A1* | 11/2009 | Kumar | A41D 31/125 2/104 |
| 2010/0138974 | A1* | 6/2010 | Carrington | A41D 15/00 2/102 |
| 2012/0047624 | A1* | 3/2012 | Hubsmith | A41D 15/00 2/125 |

* cited by examiner

NURSING GARMENT WITH INTEGRAL PRIVACY FLAP FOR USE WHILE BREASTFEEDING IN PUBLIC

CROSS REFERENCE TO RELATED APPLICATIONS

This application claims the benefit of provisional U.S. patent application Ser. No. 62/791,774, filed on Jan. 12, 2019.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to apparel tops, and more particularly to a maternity top generally having the outward appearance of a conventional T-shirt but being configurable to a nursing configuration with a privacy flap.

2. Description of Related Art

New mothers often breast feed an infant while away from the privacy of home. Accordingly, nursing garments, which combine a wearable apparel functionally adapted to facilitate the nursing of an infant, are known in the art. For example, U.S. Pat. No. 4,144,593, issued to Timmons, discloses a fashionable blouse having a large front panel hinged at the top with buttons and/or other fasteners along the sides of the panel to allow for nursing of an infant without requiring removal of the blouse. U.S. Pat. No. 890,614, issued to Culver, discloses a nursing garment wherein access to the breast is provided from the front. U.S. Pat. No. 4,004,294, issued to Pinch, discloses a disguised nursing garment in the form of a conventional women's blouse. The published application to Hendrickson, Pub. No. 2009/0265830, discloses a nursing garment that has an outer bodice which pulls down. The other published application to Hendrickson, Pub. No. 2009/0265830, discloses a nursing garment that has an outer bodice which pulls up.

The references disclosed in this section are burdened by significant limitations and deficiencies that have prevented widespread use and commercial acceptance. Accordingly, there exists a need in the art for advancements in the field of modern apparel, and particularly for stealthily designed modern apparel for nursing mothers which facilitates breastfeeding in public areas by providing access to the mother's breasts while at the same time providing a privacy flap for allowing discrete breastfeeding.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56(a) exists.

BRIEF SUMMARY OF THE INVENTION

The present invention overcomes the limitations and disadvantages present in the art by providing maternity apparel having the outward appearance of a conventional women's top but being configurable to a nursing garment configuration with an integral privacy flap which allows for discrete and concealed breastfeeding even in public spaces. A maternity apparel top in accordance with the present invention comprises a generally T-shirt shaped garment having front and back portions, left and right sleeves, and a neck opening. A significant aspect of the present invention relates to providing a combined nursing garment that in all outward appearances is a fashion conforming top, such a T-shirt or similar top. A second significant aspect of the present invention relates to providing a nursing mother with convenient and discrete access to the breast to allow for breastfeeding or utilization of a breast pump. A third significant aspect of the present invention relates to providing a nursing garment which functions to provide a privacy flap that is integrally formed with the front of the garment and configurable between: (a) a normally worn, non-breastfeeding configuration wherein the privacy flap forms the front outer layer of the garment and is affixed to the garment by invisible fasteners running along the side seams; and (b) a breastfeeding configuration wherein the front layer is deployed to form a privacy flap capable of concealing the breast and infant while breastfeeding.

Accordingly, it is an object of the present invention to provide advancements in the field of maternity apparel.

It is another object of the present invention to provide advancements in the filed of garments used while nursing an infant.

Still another object of the present invention is to provide a breastfeeding garment that is both fashionable and functional.

Yet another object of the present invention is to provide a breastfeeding garment that provides an integral privacy flap concealed within an otherwise conventional looking shirt.

These and other objects are met by the present invention which will become more apparent from the accompanying drawing and the following detailed description of the drawings and preferred embodiments.

DETAILED DESCRIPTION OF THE INVENTION

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

In describing this invention, the word "affixed" is used. By "affixed" is meant that the article or structure referred to is joined, either directly, or indirectly, to another article or structure. By "indirectly joined" is meant that there may be an intervening article or structure imposed between the two articles which are "affixed". "Directly joined" means that the two articles or structures are in contact with one another or are essentially continuous with one another. By adjacent to a structure is meant that the location is near the identified structure.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Turning now to the drawings, FIGS. 1-7 depict a nursing garment, generally referenced as 10, according to the present invention. In a preferred embodiment, garment 10 has the outward appearance of a conventional women's top and includes a front, generally referenced as 12, a back 14, a neck opening 16 and a pair of sleeves 18. Nursing garment 10 may be fabricated from cotton, a cotton blend, or any other suitable material. The present invention may be configured to any length, style, neckline, and sleeved type of garment. Accordingly, the term "garment" shall be broadly construed include apparel shirts, tops, dresses, jumpsuits, jackets, blouses etc.

Figure 1:
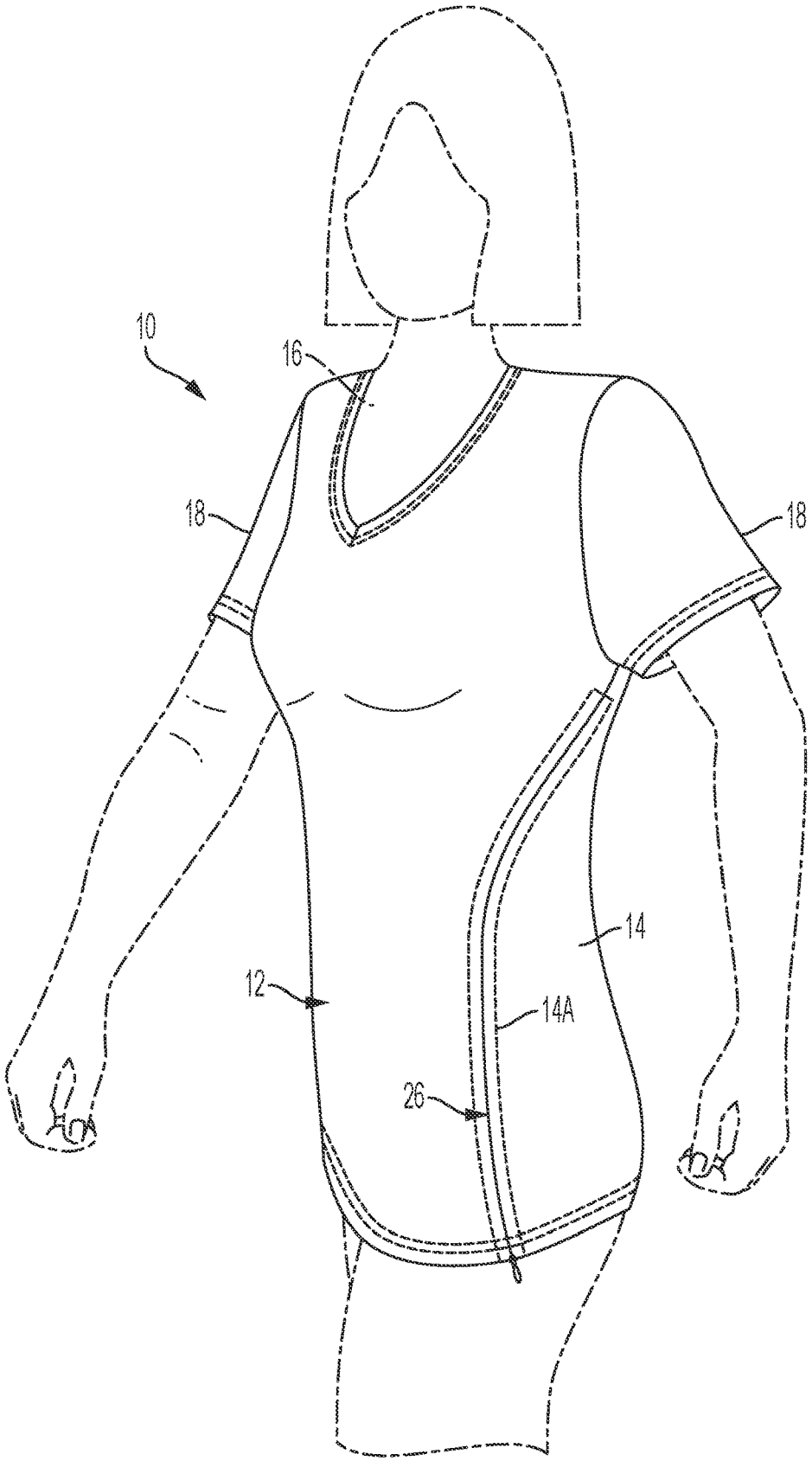
FIG. 1 is front perspective view of a nursing garment in accordance with the present invention.
Figure 2:
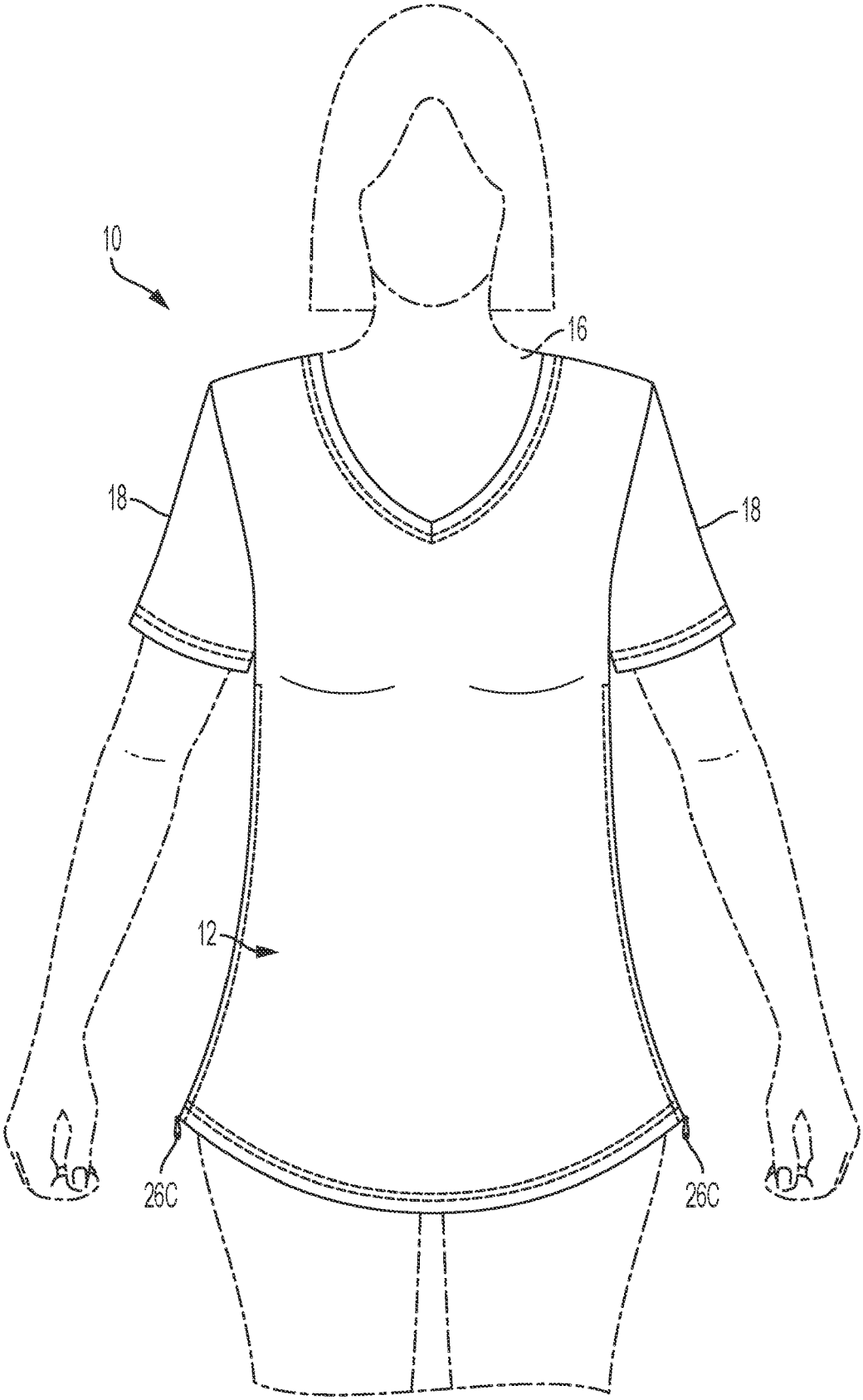
FIG. 2 is a front view thereof.
Figure 3:
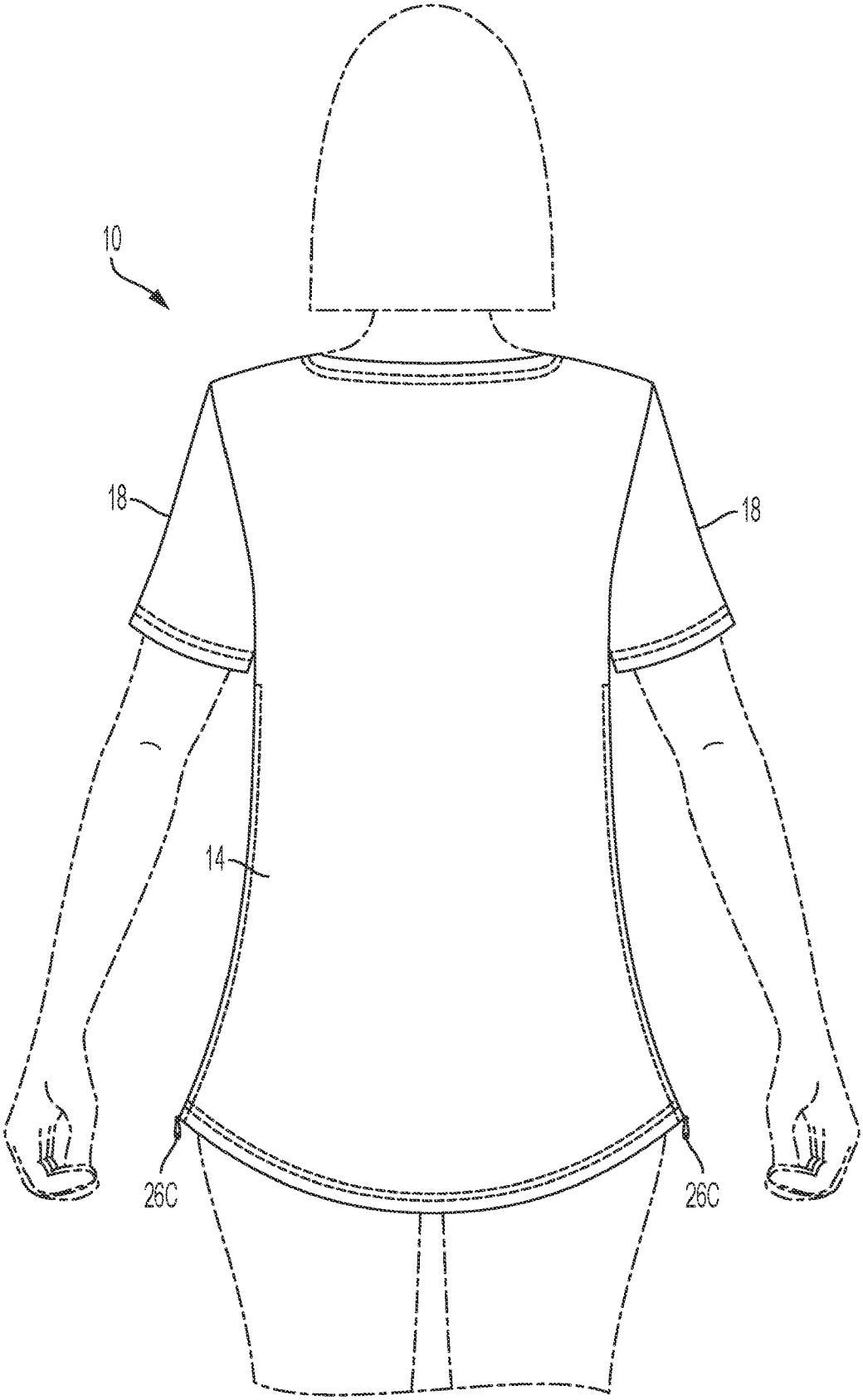
FIG. 3 is a back view thereof.
Figure 4:
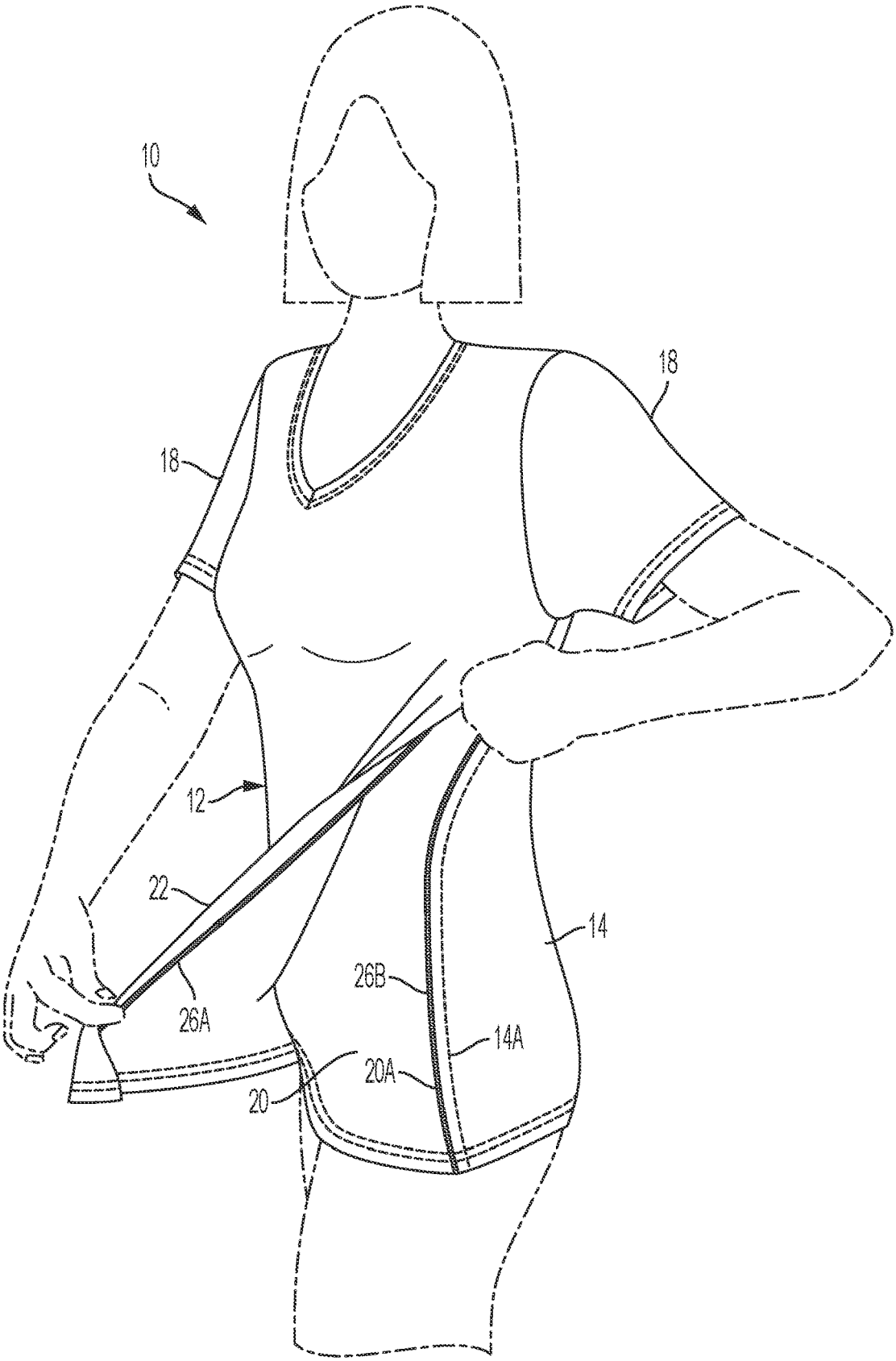
FIG. 4 is a side perspective view thereof illustrating deployment of the privacy flap.
Figure 5:
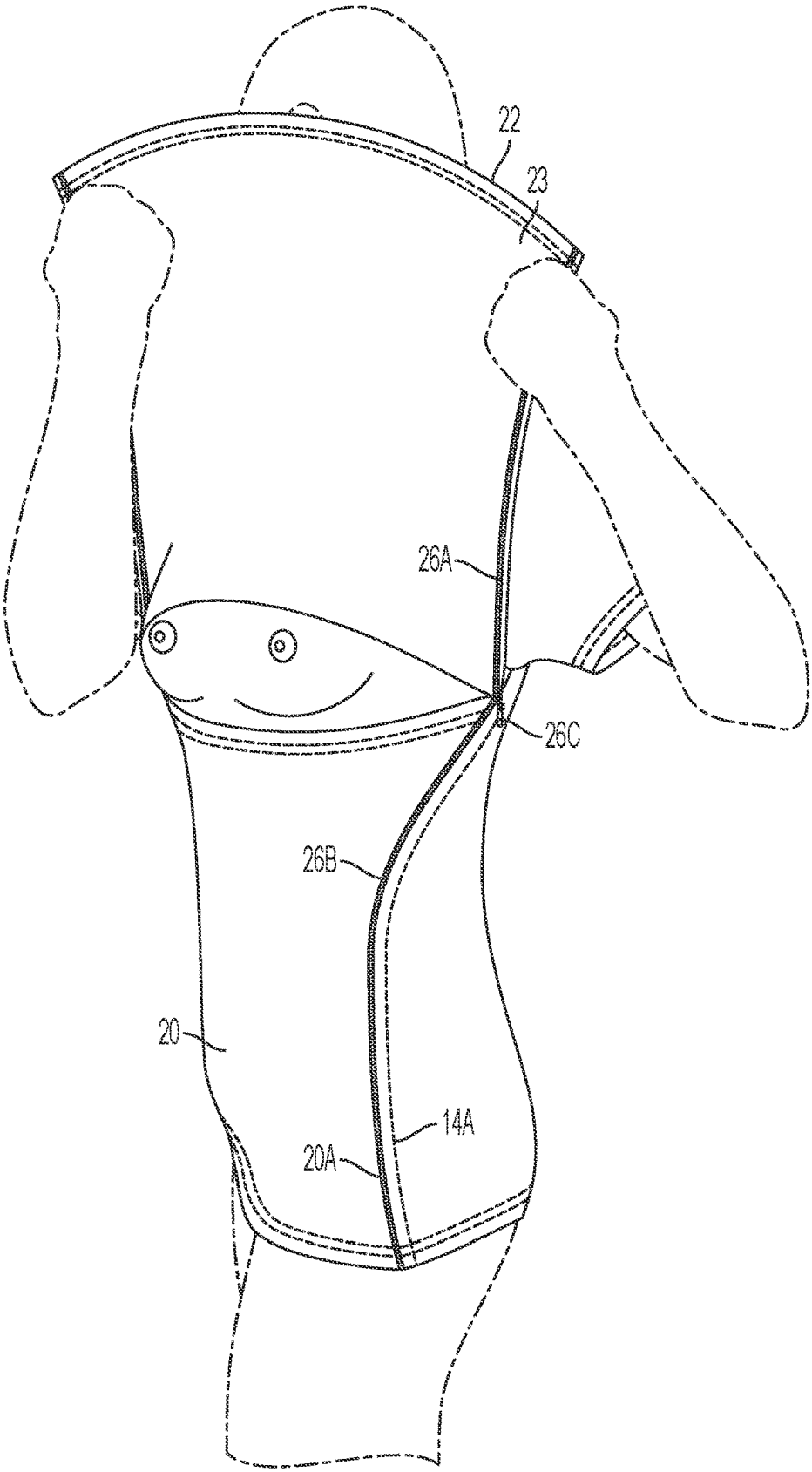
FIG. 5 is a side perspective view thereof illustrating the privacy flap in a released and raised position.
Figure 6:
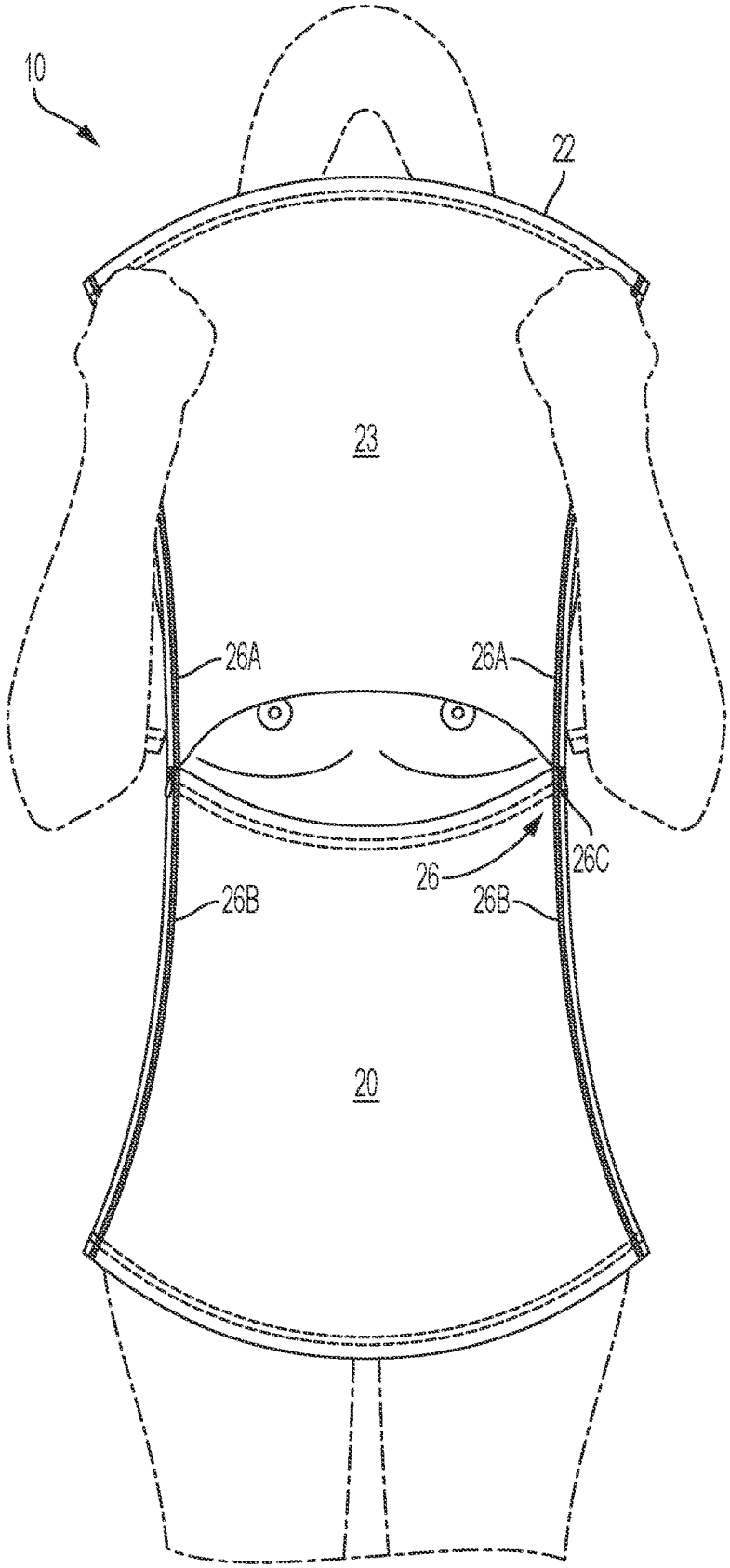
FIG. 6 is a front view thereof.
Figure 7:
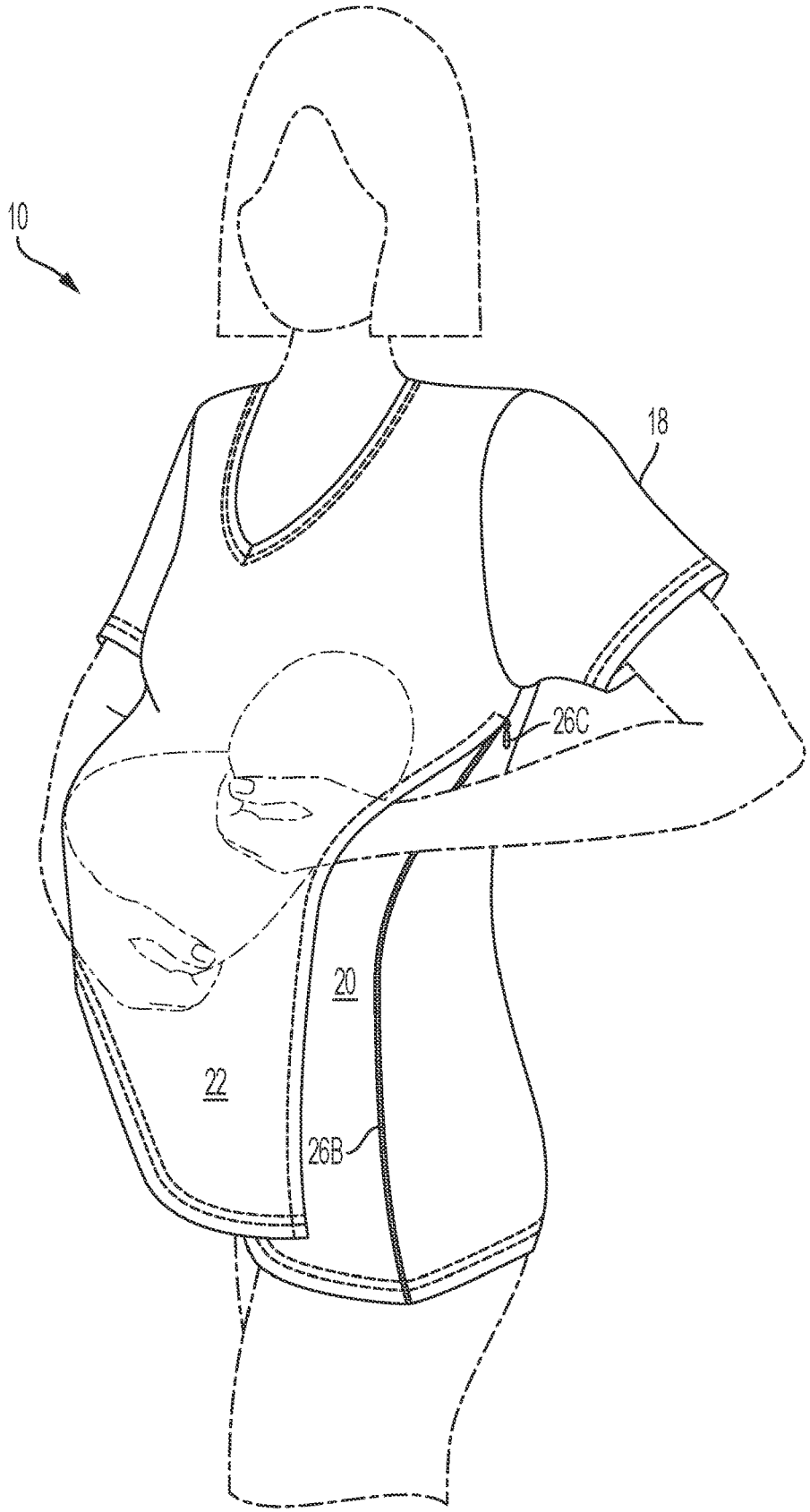
FIG. 7 is a side perspective view illustrating the breastfeeding garment in use.

A significant aspect of the present invention involves providing the front 12 of garment 10 with a multi-layered configuration. More particularly, as best illustrated in FIGS. 4-6, the front 12 of garment 10 includes an inner layer 20 and an outer layer 22. Inner layer 20 covers the wearer's torso and terminates at its uppermost edge just below the wearer's breasts to allow for exposure thereof while breastfeeding. Inner layer 20 is permanently connected on opposing lateral sides thereof, each referenced as 20A, to corresponding adjacent lateral side edges 14A of the back 14 of garment 10, wherein the upper most portion of the lateral sides of inner layer 20 terminate proximal the lower seam of the sleeve as seen in FIG. 5. Inner layer 20 may be formed of any suitable fabric or material and may further incorporate liquid repellant characteristics. In an alternate embodiment inner layer 20 may be fabricated from resilient shape wear material to shape the form of the wearer.

Outer layer 22 extends downward from the top of the shoulders to form the front 12 of garment 10. Outer layer 22 is removably affixed to corresponding adjacent lateral side edges 14A of the back 14 of garment 10 by invisible zippers 26 which run from the bottom edge of garment 10 to an area just below the seam which connects the sleeve(s) 18 to the garment. The use of invisible zippers is significant as the zipping elements are concealed from view thereby providing a combined nursing garment that in all outward appearances is a conventional fashion top, such a T-shirt or similar fashion apparel, with conventional seams. FIGS. 4-6 illustrate deployment of the outer layer 22 to the privacy flap configuration may actuation of zipper 26 from the fully connected lower position to the disconnected upper position. As best seen in FIGS. 4 and 5, zipper elements/teeth, referenced as 26A and 26B are affixed to the lateral edge of outer layer 22 and a corresponding lateral edge of the back 14 of garment 10 and are attached and detached by a slider 26C. The zipper elements 26A and 26B and slider 26C are concealed by overlapping flaps of material. Once deployed, outer layer 22 is used as a privacy flap for a mother while breastfeeding or utilizing a breast pump. Outer layer 22 is preferably fabricated from the same material as used to form the back 14 and sleeves 18. Further, outer layer 22 may have an inner water-proof, water-resistant, or water-repellant lining 23 to prevent breast milk leakage from showing through outer layer 22.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A breastfeeding garment for nursing mothers, said garment comprising: an apparel top having a front portion, a back portion, a neck opening, shoulder portions disposed on either side of said neck opening, and sleeves; said front portion including an inner layer and an outer layer; said inner layer including opposing lateral side edges affixed to corresponding side edges of said back portion, said inner layer having an upper edge extending continuously across said front portion between said opposing lateral side edges and terminating on opposing sides adjacent to and below said sleeves and extending downward therefrom to a bottom edge, said upper edge configured to terminate just below the wearer's breasts to allow exposure thereof while breastfeeding; said outer layer extending from said neck opening to a bottom edge and including opposing lateral side edges removably affixed to corresponding side edges of said back portion by invisible zippers; each of said invisible zippers each extending from a bottom side edge of said outer layer upward to one of said sleeves; said invisible zippers being configurable between a lowermost position wherein said outer layer is affixed to said back portion and an uppermost position wherein the lateral side edges of said outer layer are detached whereby a portion of said outer layer may be deployed as a privacy flap that conceals the act of breast feeding.

2. The garment according to claim 1 wherein said inner layer is fabricated from resilient material.

* * * * *